US005962805A

United States Patent [19]

Saxby

[11] Patent Number: 5,962,805

[45] **Date of Patent: *Oct. 5, 1999**

[54] GAS CARTRIDGE

[75] Inventor: Michael Ernest Saxby, East Sussex, United Kingdom

[73] Assignee: Constantia (International) Limited, Queensway, Gibraltar

[ * ] Notice: This patent is subject to a terminal disclaimer.

[21] Appl. No.: 08/942,983

[22] Filed: Oct. 2, 1997

Related U.S. Application Data

[63] Continuation of application No. 08/596,303, filed as application No. PCT/GB94/01779, Aug. 15, 1994, Pat. No. 5,700,972.

[30] Foreign Application Priority Data

Aug. 16, 1993 [GB] United Kingdom ..... 9317040

[51] Int. Cl.[6] ..... F42B 5/02; F41B 11/06

[52] U.S. Cl. ..... 102/440; 102/444; 124/57; 124/74; 124/75

[58] Field of Search ..... 102/430, 440, 102/444; 124/57, 70, 71, 73, 74, 75, 76; 223/3

[56] References Cited

U.S. PATENT DOCUMENTS

| | | | |
|---|---|---|---|
| 387,256 | 8/1888 | Pratt | 102/430 |
| 2,327,653 | 8/1943 | Lisle | 102/430 |
| 3,830,214 | 8/1974 | Curtis | 124/57 |
| 4,531,458 | 7/1985 | Saxby . | |
| 4,686,905 | 8/1987 | Szabo | 102/444 |
| 5,272,983 | 12/1993 | Sippel et al. | 102/430 |
| 5,335,600 | 8/1994 | Horr et al. | 102/430 |
| 5,492,063 | 2/1996 | Dittrich | 102/444 |
| 5,700,972 | 12/1997 | Saxby | 102/440 |

FOREIGN PATENT DOCUMENTS

| | | | |
|---|---|---|---|
| 0189974 | 8/1986 | European Pat. Off. . | |
| 0499332 | 8/1992 | European Pat. Off. . | |
| 2369537 | 5/1978 | France . | |
| 2403536 | 4/1979 | France . | |
| 2822624 | 12/1978 | Germany | 102/444 |
| 1601918 | 11/1981 | United Kingdom . | |
| 2116681 | 9/1983 | United Kingdom . | |
| 2153983 | 8/1985 | United Kingdom . | |
| 2154714 | 9/1985 | United Kingdom . | |
| 2211588 | 7/1989 | United Kingdom . | |

*Primary Examiner*—Harold J. Tudor
*Attorney, Agent, or Firm*—Dowell & Dowell, P.C.

[57] ABSTRACT

A cartridge has a case comprising a body housed telescopically within a sleeve. The body encloses a main chamber which contains gas under pressure, and a valve mechanism for venting gas from the chamber into an expansion chamber. The pressure of the gas in the expansion chamber causes the body to move rearwardly relative to the sleeve to apply a force to the breech block of the weapon in which the cartridge is used, thereby to initiate the reloading cycle. Gas is vented from the expansion chamber to eject a projectile when a spigot projecting from the body is withdrawn from an aperture in the end wall of the sleeve.

10 Claims, 4 Drawing Sheets

GAS CARTRIDGE

CROSS REFERENCE TO RELATED APPLICATION

This application is a continuation application of U.S. Ser. No. 08/596,303 filed Feb. 13, 1996, now U.S. Pat. No. 5,700,972 based on PCT/GB94/01779 filed Aug. 15, 1994, entitled GAS CARTRIDGE in the name of the same inventor.

BACKGROUND OF THE INVENTION

1. Field of the Invention

The present invention relates to pressurised gas cartridges of the type which may be used in place of conventional pyrotechnic cartridges.

2. History of the Related Art

Pressurised gas cartridges are known, one example being that disclosed in European Patent specification EP-A-499 332, to which reference should be made. A disadvantage of the known types of gas cartridges is that they are incapable of generating sufficient rearward force to actuate recoil-operated automatic and semi-automatic weapons. Such weapons depend upon the breech block being moved rearwardly under force applied to it upon firing of a round of ammunition in order to set in train the reloading and recocking cycle.

SUMMARY OF THE INVENTION

To overcome this problem it is proposed herein that a gas cartridge should have a first part which is displaced on firing relative to a second part, so as to apply the necessary force to the breech block to recycle the weapon. In a preferred embodiment, gas used to eject a projectile from the cartridge disclosed in the above mentioned specification is admitted to an expansion chamber prior to being used to eject the projectile, where it acts on the rearwardly movable part.

Preferably the cartridge case is of telescopic construction and has a sleeve which is slidably mounted on a body housing the gas chambers and operating parts. The sleeve may have a forward end wall which overlies the forward end wall of the body, and the expansion chamber is defined between the two end walls. The pressure of gas in the expansion chamber acts on the end wall of the body and drives the body rearwardly in the manner of a piston. The sleeve is held in place by engagement with the wall of the chamber of the weapon. The gas is subsequently discharged from the expansion chamber and used to eject the bullet or other projectile. The moment at which the gas is discharged from the expansion chamber is preferably determined by the sleeve and body entering predetermined relative positions. To this end, the body may have an axially extending spigot which normally projects into and obturates an aperture in the end wall of the sleeve. The relative movement between the sleeve and body leads to the spigot being progressively withdrawn from the aperture until, in the predetermined relative positions, the spigot is withdrawn from the aperture and the gas from the expansion chamber exhausts through it. Although the bullet or other projectile may be held in place to the rim of the sleeve in a conventional way, it may alternatively be fitted to the spigot from which it is released at the instant the pressurised gas is applied to the projectile. Other arrangements for causing a part of a cartridge to be displaced rearwardly may be used in place of that described above.

DESCRIPTION OF THE DRAWING FIGURES

FIG. 1 is a longitudinal section through a pressurised gas cartridge in its charged state prior to firing, FIG. 2 shows the parts in their relative positions shortly after firing, FIG. 3 shows the parts in their relative positions at the end of the firing sequence, and FIG. 4 is a schematic longitudinal cross section through a portion of a weapon loaded with a gas cartridge according to the present invention.

DESCRIPTION OF THE PREFERRED EMBODIMENT

The preferred embodiment of the invention will be described in the context of the cartridge disclosed in the above-mentioned specification to which reference should be made for a full understanding of the operating mechanism and its manner of operation.

Figure 1:
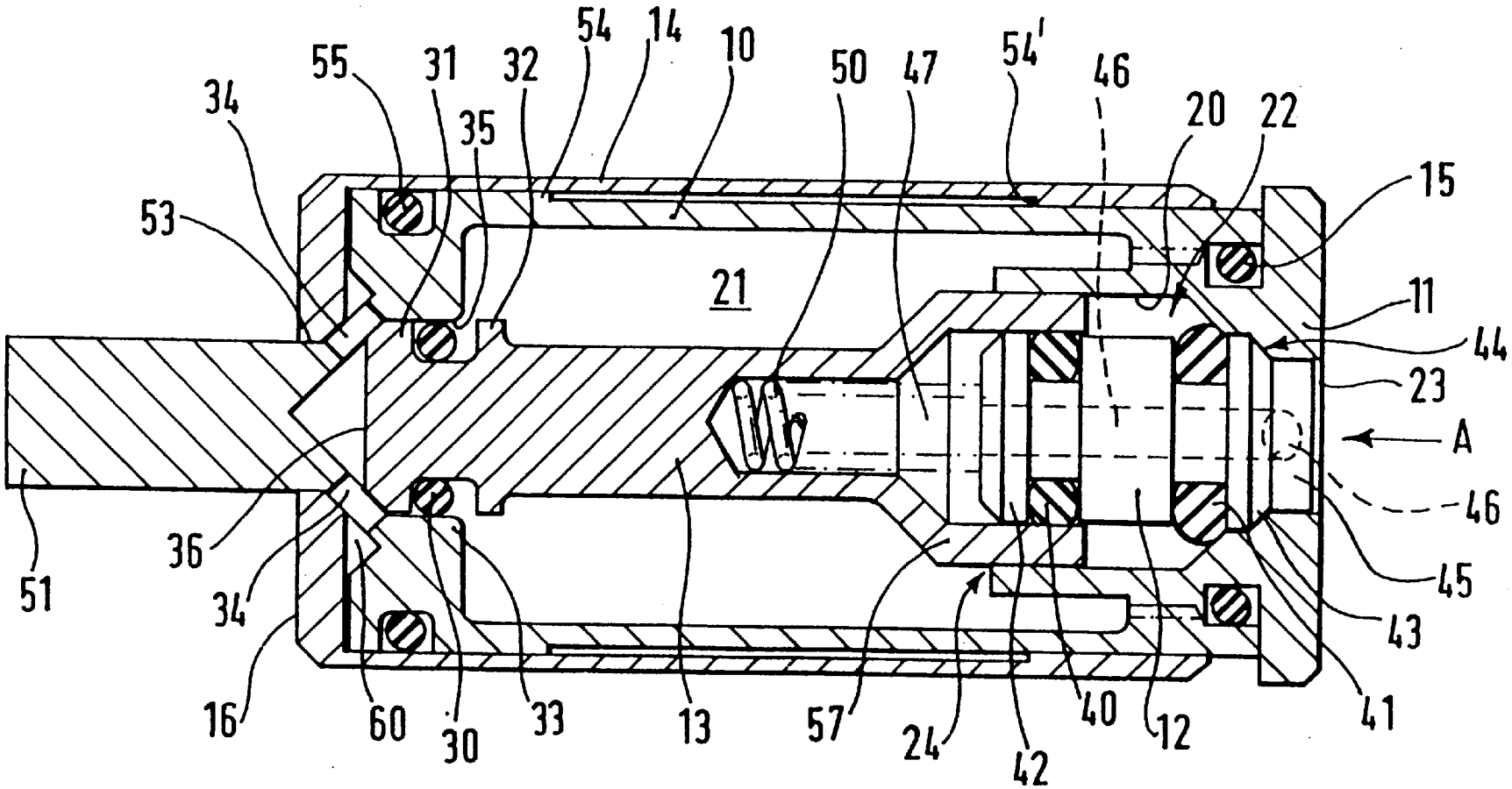
Figure 4:
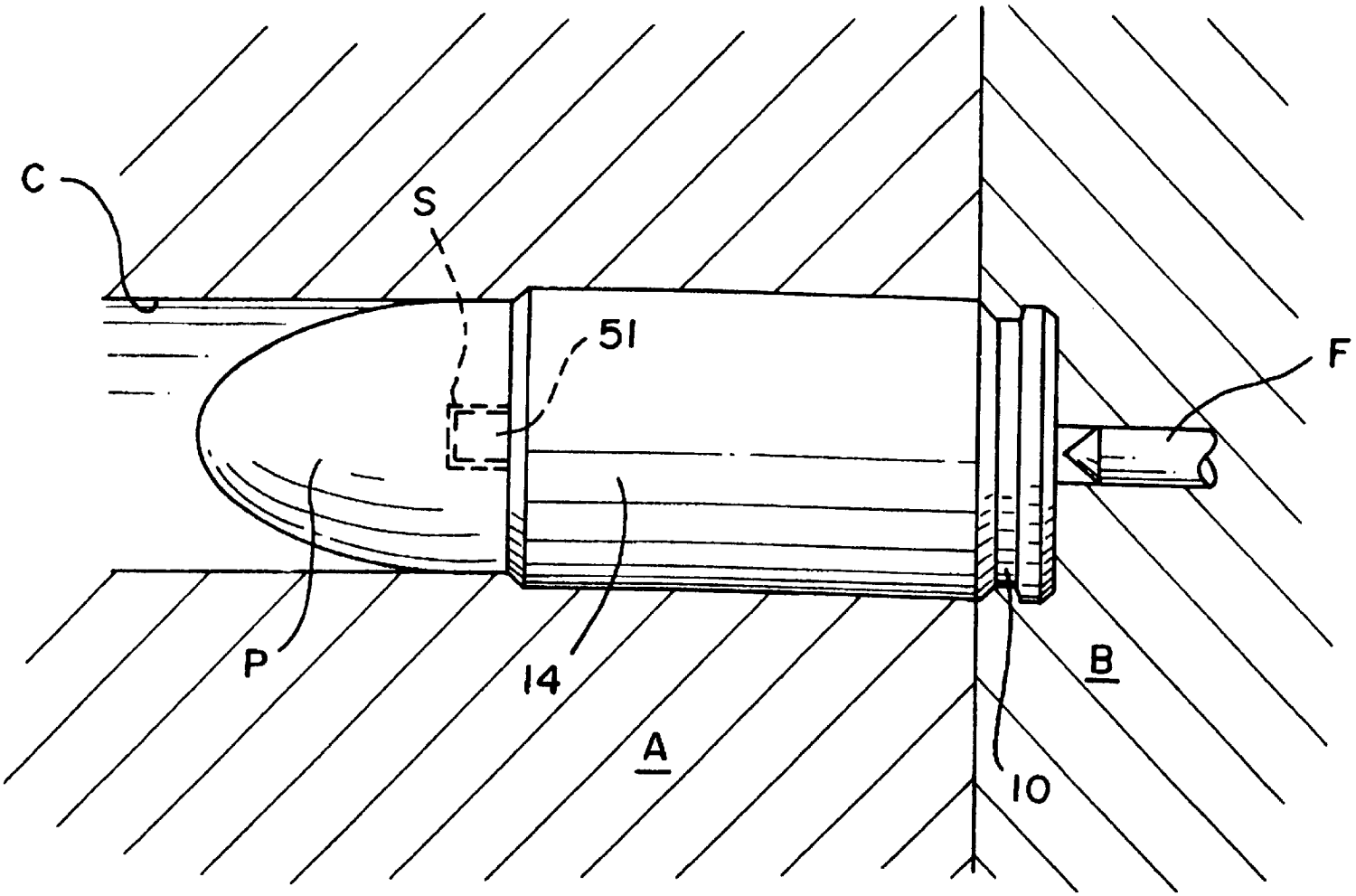

Referring to FIG. 1, the cartridge proposed herein has a two-part case formed from a body 10 and a sleeve 14 mounted telescopically on the body. A projectile "P" is disposed at the forward end of the cartridge. In use, the cartridge is loaded into the chamber "C" of a conventional gun having a barrel "A" breech block "B" and firing pin "F", all shown in FIG. 4. The sleeve has a radially inwardly extending wall 16 at its forward end which bounds an aperture 53. Because the cylindrical portion of the sleeve is not under any gas pressure it may have a relatively thin wall. The body is provided at its forward end with an external annular shoulder 54 arranged to cooperate with an internal shoulder 54' at the rearward end of the sleeve in order to limit relative movement of the two parts. An O-ring 55 seals the body to the sleeve at their forward ends.

The body has a radially inwardly extending front wall 33 at its forward end which in the charged state is in close contact with the end wall of the sleeve. An axial spigot 51 projects from the wall 33 and is a sliding fit in the aperture 53. The spigot functions as a slide valve and normally closes the aperture 53. A cavity 35 in the inner side of the wall 33 has a cylindrical portion which serves as a seat for the head 36 of a piston valve having a stem 13. The end wall of the cavity is conical in shape and formed with ports 34 opening into an annular V-sectioned groove in the outer surface of the end wall 33. The groove 60 forms a part of an expansion chamber to be described later. The valve head 36 is formed with a pair of collars 31, 32 defining a groove which receives an O-ring sealing the valve head against the cavity.

An insert 11 is screwed into the rearward end of the body and is sealed relative to the body by an O-ring 15. The insert has a cylindrical extension which defines a bore 20 which guides a skirt portion 57 at the rearward end of the stem 13. A primary gas chamber 21 surrounding the piston valve contains a gas, conveniently air, under a pressure which is preferably at least 50 bar ($5\times10^7$ Pa) and more preferably substantially 200 bar ($2\times10^7$ Pa).

In the charged state of the cartridge as shown in FIG. 1, the body and sleeve are in their closed positions with the two end walls juxtaposed.

Figure 2:
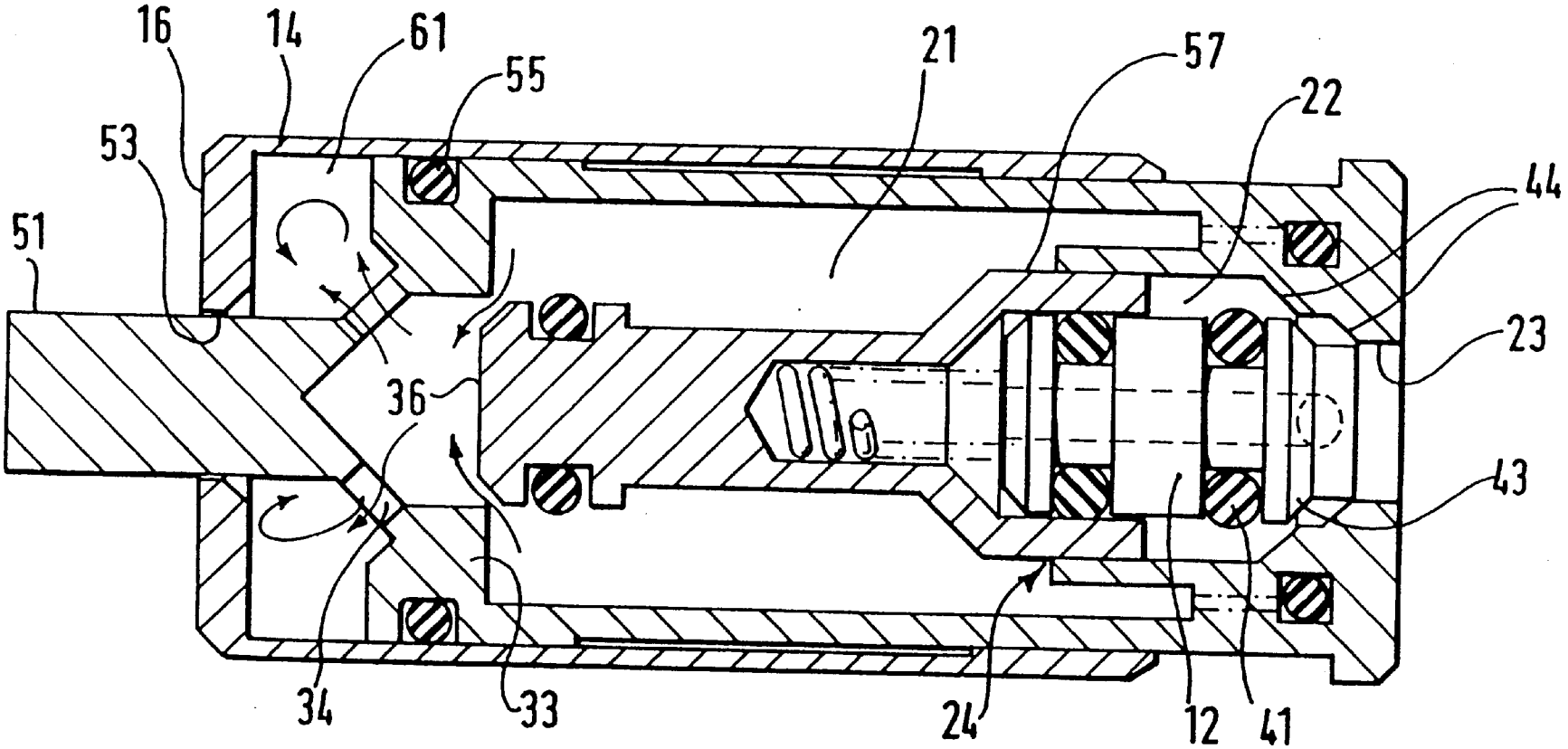
Figure 3:
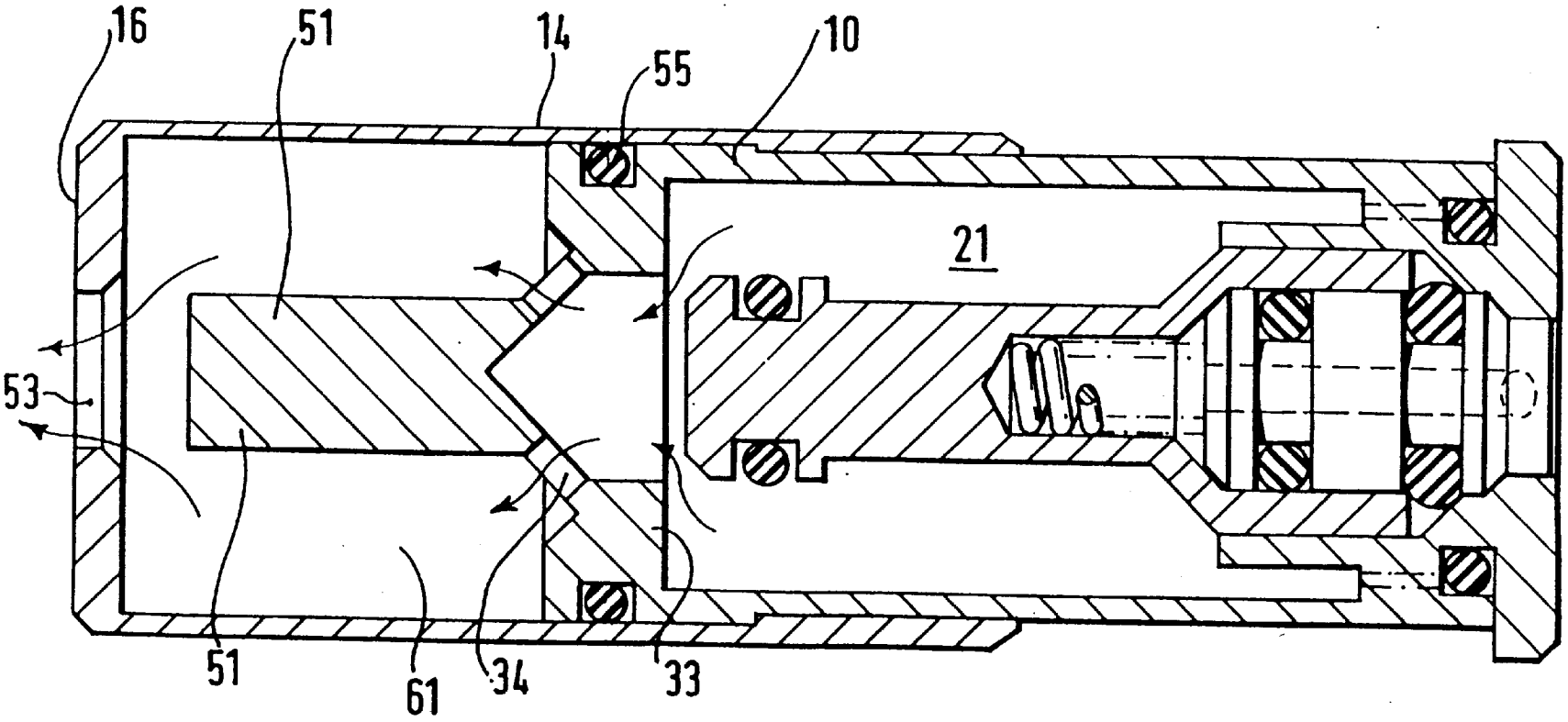

Upon the cartridge being fired, the piston valve is moved rearwardly, initially into the position shown in FIG. 2. The valve head 36 is therefore withdrawn from the cavity 35 and frees the ports 34. Gas from the primary chamber escapes into the groove 60 and causes the body to begin its rearward movement relative to the sleeve. This movement begins the enlargement of an expansion chamber 61 which continues to enlarge as rearward movement of the body continues. Gas is prevented from escaping between the body and sleeve by the O-ring 55. During this movement the spigot slides back through the aperture 53 until eventually it is withdrawn completely therefrom into the position shown in FIG. 3. The air from the expansion chamber now escapes through the aperture 53 and ejects the projectile P carried by the cartridge. The projectile may be held in place by a lip on the rim of the wall 16, or may be provided with a socket S which receives the spigot 51. In the charged state of the cartridge as shown in FIG. 1, the body and sleeve are in their closed positions with the two end walls juxtaposed.

The operating mechanism for the cartridge is substantially as described in the above-mentioned specification and will therefore be described only briefly.

The rearward movement of the piston valve is initiated by displacement of a relief valve which comprises a spool member supported within the skirt 57 of the piston valve. The spool member has a central body portion 12 and forward and rearward shoulders 42, 43 defining grooves for receiving O-rings 40, 41. A stem portion 45 extends rearwardly from the shoulder 43 and is located. within a relief passage 23. Frusto-conical valve seats 44 in the relief passage 23 are contacted by a complementary portion of the rearward shoulder and by the rearward O-ring. The forward O-ring 40 is sealed against the bore within the skirt 57. A compression spring 50 applies a relatively weak pressure to the spool member. Two chambers are thereby formed, namely a secondary chamber 22 located between the end of the skirt 57 and the seal ring 41 and third chamber 47 located within the skirt 57 forwardly of the shoulder 42. The chamber 22 is in communication with the primary chamber 21 through a bleed passage 24 existing between the skirt and the bore 20, so that in the charged state the pressures within the chambers 21 and 22 are equalised. A duct 46 extends through the spool member to connect the chamber 47 to a vent in the peripheral surface of the stem portion, whereby the chamber 47 is at atmospheric pressure.

Upon the stem portion 45 being struck by a firing pin F moving in the direction of the arrow "A", the spool member is propelled into the skirt, so lifting the rearward shoulder 43 and O-ring 41 from their seats.

Gas in the chamber 22 vents to atmosphere through the relief passage. Although some gas flows through the bleed passage 24 from chamber 21, this flow is negligible and does not prevent the pressure in the chamber 22 falling sharply. The gas in chamber 21 applies pressure to the forward surface of the skirt 57 which greatly overcomes that applied by gas in chamber 22 to the rearward rim of the skirt, and the piston valve tends to move rearwards, as discussed above. Because chamber 47 is at atmospheric pressure and able to vent through duct 46, the spool member is drawn into the skirt, thereby allowing the piston valve to move towards the position shown in FIG. 3.

By varying the length of the spigot 51 or the length of the body of the cartridge or the ratio of the former to the latter, the time at which gas is released and the projectile discharged may be adjusted relative to the rearward motion of the body.

A cartridge in accordance with the invention has the advantage over pyrotechnic cartridges that it is reusable. It is therefore very suitable for use as training ammunition, particularly for semi-automatic pistols and other recoil-operated weapons. The cartridge may also be particularly suitable for use in paint-ball guns, because the ball may be adapted easily to fit on the spigot 51. Although the cartridge has been described as being used to eject a projectile, it will be appreciated that it may be used as a "blank" without a projectile but will still be capable of applying force to the breech block B.

Modifications may be made to the cartridge described herein within the scope of the invention. In particular, other types of valve arrangements may be employed to admit gas to the expansion chamber in response to the cartridge being struck by the firing pin, and other valve arrangements may be used to discharge gas from the expansion chamber and the desired instant.

I claim:

1. A pressurized gas cartridge for use with a weapon having a moveable breech block, the gas cartridge comprising; a body in which a compressed gas is contained surrounded telescopically by a sleeve, a valve means within the body to control release of the compressed gas from the body, means for opening the valve means to release the compressed gas from the body upon firing of the cartridge, means responsive to the release of the compressed gas from the body for causing the body to move rearwardly relative to the sleeve, the cartridge having forward and rearward ends, the means responsive to the release of the compressed gas from the body including an expansion chamber located adjacent the forward end of the cartridge to receive the compressed gas which exits the body upon firing of the cartridge and opening of the valve means, the sleeve and body having respective forward walls which define forward and rearward ends of the expansion chamber, pressure of gas when entering the expansion chamber being sufficient to move the body rearwardly relative to the sleeve to increase the overall length of the cartridge such that the cartridge applies sufficient force to the breech block of the weapon in which the cartridge is used, thereby to recycle the weapon, and means for discharging gas from the expansion chamber upon a predetermined amount of movement of the body relative to the sleeve.

2. A pressurized gas cartridge for use with a weapon having a moveable breech block, the cartridge comprising; a body housed telescopically within a sleeve, the body and sleeve each having a rearward end, a cylindrical wall port ion and a front wall portion, the front wall portion of the sleeve being disposed forwardly of the front wall portion of the body, the sleeve being open at its rearward end and the body extending rearwardly through said open rearward end of the sleeve, a primary gas chamber defined within the body, said primary gas chamber containing compressed gas, an expansion chamber defined between the front wall portions of the body and the sleeve, first gas outlet means for admitting gas to the expansion chamber from the primary gas chamber to cause telescopic movement between the body and sleeve, first valve means for controlling the escape of gas through said first gas outlet means, means for opening the first valve means upon firing of the cartridge, second gas outlet means for discharging gas from the expansion chamber to eject a projectile, and second valve means for controlling the escape of gas through the second gas outlet means, the second valve means opening the second gas outlet means fully upon predetermined relative movement between the sleeve and body caused by gas entering the expansion chamber from the primary gas chamber, the relative movement causing an overall length of the cartridge to increase and apply force to the breech block of the weapon in which the cartridge is used, thereby to recycle the weapon.

3. A pressurized gas cartridge as claimed in claim 2, wherein the second valve means comprises a spigot extending forwardly from the front wall portion of the body and passing through the second gas outlet means.

4. A pressurized gas cartridge as claimed in claim 3, further including a projectile mounted on the spigot.

5. A pressurized gas cartridge for use with a weapon having a moveable breech block, the gas cartridge comprising;

a) a body having a cylindrical peripheral wall and a front end wall, the peripheral and front end walls bounding a primary gas chamber containing compressed gas, a valve for releasing gas from the primary gas chamber, and means for opening the valve upon firing of the cartridge, b) a sleeve having a cylindrical peripheral wall and a front end wall, c) the body being slidably received within the sleeve with the front end wall of the body disposed rearwardly of and closely adjacent to the front end wall of the sleeve, d) the front end wall of the sleeve having therein an aperture, e) a spigot extending axially forwardly from the front end wall of the body so as to pass into and through the aperture in the front end wall of the sleeve, f) the body being movable rearwardly relative to the sleeve under pressure of gas released by the valve from the primary gas chamber into a space between the front end walls of the body and sleeve, the movement increasing an overall length of the cartridge to apply force to the breech block of the weapon in which the cartridge is used, thereby to recycle the weapon, and g) the spigot being of a size to be withdrawn from the aperture in the front end wall of the sleeve upon predetermined relative movement of the body and sleeve, gas thereupon being discharged through the aperture.

6. A pressurized gas cartridge as claimed in claim 5 including an insert screwed into a rearward end of the body to define the primary gas chamber together with the peripheral and front and rearward end walls of the body.

7. A pressurized gas cartridge for use with a weapon having a moveable breech block, the cartridge comprising;

a body and a sleeve in which the body is telescopically received, the body and sleeve each having forward and rearward ends and together forming a case of the cartridge, a primary gas chamber defined within the body and containing a gas under pressure for ejecting a projectile carried at a forward end of the case, the body and sleeve cooperating to define an expansion chamber, first valve means for releasing gas from the primary gas chamber and directing such gas into the expansion chamber, and second valve means for releasing gas from the expansion chamber to eject the projectile, the body and sleeve being relatively moveable telescopically under the pressure of gas admitted to the expansion chamber so as to increase the overall length of the cartridge and apply force to the breech block of the weapon in which the cartridge is used, thereby to recycle the weapon.

8. A pressurized gas cartridge as claimed in claim 7, wherein the second valve means for releasing gas from the expansion chamber opens in response to predetermined relative movement of the body and sleeve.

9. A pressurized gas cartridge as claimed in claim 8, wherein the second valve comprises a spigot extending from the body through an aperture in the sleeve.

10. A pressurized gas cartridge for use with a weapon having a moveable breech block, the cartridge comprising; a body slidably received within a sleeve, the body and sleeve being relatively displaceable relative to one another so as to increase an overall length of the cartridge and apply force to the breech block of the weapon in which the cartridge is used so as to recycle the weapon, a primary gas chamber being located within the body, the primary gas chamber containing gas under pressure, a first valve for releasing gas from the primary gas chamber upon firing of the cartridge, a secondary chamber being disposed to receive gas from the primary gas chamber upon firing of the cartridge, a second valve for releasing gas from the secondary chamber, and the body and sleeve forming a piston and cylinder assembly so that pressure of gas in the secondary chamber displaces the body relative to the sleeve.

* * * * *